US009010733B2

(12) United States Patent
Kwon et al.

(10) Patent No.: US 9,010,733 B2
(45) Date of Patent: Apr. 21, 2015

(54) THREE-DIMENSIONAL WIRE FLYING SYSTEM

(75) Inventors: O-Hung Kwon, Seoul (KR); Dae-Hee Won, Gyeonggi-do (KR); Sang-Won Lee, Gyeonggi-do (KR); Kwan-Young Joung, Gyeonggi-do (KR); Dong-Wook Lee, Incheon (KR)

(73) Assignee: Korea Institute of Industrial Technology, Chungcheongnam-Do (KR)

( * ) Notice: Subject to any disclaimer, the term of this patent is extended or adjusted under 35 U.S.C. 154(b) by 129 days.

(21) Appl. No.: 13/702,867

(22) PCT Filed: Jan. 31, 2012

(86) PCT No.: PCT/KR2012/000720

§ 371 (c)(1),
(2), (4) Date: Dec. 7, 2012

(87) PCT Pub. No.: WO2012/134048

PCT Pub. Date: Oct. 4, 2012

(65) Prior Publication Data

US 2013/0087751 A1 Apr. 11, 2013

(30) Foreign Application Priority Data

Mar. 29, 2011 (KR) ..... 10-2011-0028117

(51) Int. Cl.

| | |
|---|---|
| ***B66D 1/26*** | (2006.01) |
| ***B66D 1/48*** | (2006.01) |
| ***B66C 15/04*** | (2006.01) |
| ***B66C 21/00*** | (2006.01) |
| ***B66D 1/54*** | (2006.01) |

(52) U.S. Cl.
CPC ..... *B66D 1/48* (2013.01); *B66C 15/045* (2013.01); *B66C 21/00* (2013.01); *B66D 1/485* (2013.01); *B66D 1/54* (2013.01)

(58) Field of Classification Search
USPC ..... 254/268, 276, 278, 269, 273, 283, 286
See application file for complete search history.

(56) References Cited

U.S. PATENT DOCUMENTS

| | | | | |
|---|---|---|---|---|
| 6,102,372 | A * | 8/2000 | Gersemsky et al. | 254/278 |
| 6,297,610 | B1 * | 10/2001 | Bauer et al. | 318/562 |
| 6,991,064 | B2 * | 1/2006 | Ehrenleitner | 182/141 |
| 7,284,744 | B1 * | 10/2007 | Lerchenmueller et al. | 254/278 |

(Continued)

FOREIGN PATENT DOCUMENTS

| | | |
|---|---|---|
| JP | 8-245185 | 9/1996 |
| JP | 10-273286 A | 10/1998 |

(Continued)

*Primary Examiner* — Emmanuel M Marcelo
*Assistant Examiner* — Angela Caligiuri
(74) *Attorney, Agent, or Firm* — Rabin Berdo, P.C.

(57) ABSTRACT

A three dimensional wire flying system includes a plurality of winches collectively hanging an object and a control unit for controlling the plurality of winches and the main safety device. Each of the plurality of winches includes a drum unit, a wire wound on the drum unit, a motor unit which provides power to the drum unit, a brake module which stops rotation of the drum unit, a limit switch which operates upon detecting a hardware limit state, and a servo-system. Each of the plurality of winches operates to move the object in a three dimensional space in three directions, including an up-down direction, a left-right direction and a forward-backward direction, and each winch provides a multi-level safety protection.

10 Claims, 5 Drawing Sheets

(56) References Cited

U.S. PATENT DOCUMENTS

| | | | | |
|---|---|---|---|---|
| 2005/0024005 | A1* | 2/2005 | Rodnunsky et al. | 318/649 |
| 2008/0128668 | A1* | 6/2008 | Fofonoff et al. | 254/334 |
| 2009/0207250 | A1* | 8/2009 | Bennett et al. | 348/144 |
| 2012/0298825 | A1* | 11/2012 | Fisher | 248/323 |
| 2012/0298937 | A1* | 11/2012 | Fisher | 254/283 |
| 2013/0238135 | A1* | 9/2013 | Fisher | 700/275 |

FOREIGN PATENT DOCUMENTS

| | | | |
|---|---|---|---|
| JP | 2002-96990 | | 4/2002 |
| JP | 2006-224202 | | 8/2006 |
| KR | 1998-020509 | | 6/1998 |
| KR | 10-2000-0034416 | A | 6/2000 |
| KR | 10-2002-0089620 | A | 11/2002 |
| KR | 10-2005-0095295 | A | 9/2005 |

* cited by examiner

THREE-DIMENSIONAL WIRE FLYING SYSTEM

CROSS-REFERENCES TO RELATED APPLICATION

This patent application is a U.S. national phase under 35 U.S.C 371 of PCT/KR2012/000720 filed on Jan. 31, 2012, which claims the benefit of priority from Korean Patent Application No. 10-2011-0028117, filed on Mar. 29, 2011, in the Korean Intellectual Property Office, the disclosure of which is incorporated herein by reference in its entirety.

BACKGROUND OF THE INVENTION

1. Field of the Invention

The present invention relates to a three dimensional (3D) wire flying system.

2. Description of the Related Art

Fail-safe is generally known to be a device to prevent or minimize harm in advance by employing a multilevel of safety measures, when the harm is likely due to fault in a system or manmade fault.

For example, when power supply to an elevator is ceased, thereby bringing the elevator to a sudden stop in operation, an emergency brake is operated to keep elevator from falling so as to secure the passengers' lives until rescue gets to the site. Additional examples may include multi-protective device of nuclear reactor, a mixer device which does not operate blades unless cap is securely sealed, a circuit breaker trip which prevents electric fire, a fail-safe system (derailing point, safety siding, on-board receiver, way-side transmitter, driver alarm system, emergency brake, etc.) implemented in rail facility.

The fail-safe may also be implemented in a system utilizing winch. For example, a wire flying system which employs a combination of a plurality of winches involves unexpected damages when abnormality occurs in the winches or software that controls the winches, or when abnormality occurs in a hardware that detects and manages abnormality of the winches or the controlling software.

Accordingly, in order to prevent or minimize possible harm that can occur due to various causes particularly in a system that utilizes winches, demand is increasing for a winch fail-safe that can ensure safe use of the winches in various levels.

SUMMARY OF THE INVENTION

Technical Problems

Accordingly, the present invention has been created to solve the problems mentioned above, and it is an object of the present invention to provide a three dimensional (3D) wire flying system which is capable of preventing at various levels a possible harm that can occur in a system utilizing winches due to various causes.

Means to Solve the Problems

In order to achieve the objects explained above, the present invention provides a three dimensional wire flying system which hangs an object on a wire adjustable in its length by a winch and moves the object in a three dimensional space, wherein the winch includes a drum unit on or from which the wire is wound or unwound, a motor unit which provides power to the drum unit, a brake module which stops rotation of the drum unit, a limit switch which operates upon detecting a hardware limit state, and a servo-system which controls the motor unit in response to a command from a control unit, determines state of the wire and the motor unit according to a local safety logic and transmits the state of the wire and the motor unit to the control unit. The three dimensional space includes a first range, a second range corresponding to a preset safe length of the wire, and a third range corresponding to a preset permissible length range of the wire. If the local safety logic determines that operating range of the wire deviates from the first range only, the local safety device transmits information about the deviation from the first range to the control unit, and the control unit transmits a software limit signal to the servo-system to control the motor unit, so that the operating range of the wire returns into the first range. If the local safety logic determines that the length of the wire deviates from the second range, the local safety device transmits information about the deviation from the second range to the control unit, and the control unit transmits a software limit signal to the servo-system to stop the operation of the motor unit. If the local safety logic determines that the length of the wire deviates from the third range, the limit switch detects hardware limit state and mechanically stops the operation of the motor unit to thus stop the rotation of the drum unit, thereby implementing safety control at hardware level.

If the local safety logic may determine a local warning state in which the power provided by the motor unit to the drum unit is 0 or deviates from a preset power range, the local safety device transmits information about the local warning state to the control unit, and the control unit may stop the operation of the motor unit.

The second range may be included in the third range.

The winch may include one or more winches, and the three dimensional wire flying system may include an integrated safety device which determines state of the one or more winches according to a safety logic and transmits information about the state of the one or more winches to the control unit.

If the safety logic determines a warning state in which any of the one or more winches has deviation of the length of the wire unwound from the drum unit from the second range or in which the power provided by the motor unit to the drum unit deviates from a preset power range, the integrated safety device may transmit information about the warning state to the control unit and the control unit may stop the operation of the one or more winches altogether.

If any of the one or more winches is determined to be in local warning state via the local safety device, the local safety device may transmit information about the local warning state to the integrated safety device to implement an integrated synchronous motion in which the integrated safety device stops the operation of the one or more winches altogether.

The integrated safety device may transmit information about the warning state to the local safety devices of the one or more winches to implement a local synchronous motion in which the local safety devices of the one or more winches stop the operation of the one or more winches, respectively.

The three dimensional wire flying system may additionally include an emergency switch which, independently from the local safety device or the integrated safety device, mechanically detects emergency state to control the motor unit and the brake module.

Effect of the Invention

According to the present invention, safety control is ensured based on dual-system of a local safety device and an integrated safety device, in which stopping of the winch at software level and hardware level are implemented in stepwise manner, and efficient stop is implemented based on mechanical detection at an emergency switch, whereby possible harm that may arise in a three dimensional (3D) flying system due to various causes can be prevented at several levels.

BRIEF DESCRIPTION OF THE DRAWINGS

The above and/or other aspects and advantages of the present invention will become apparent and more readily appreciated from the following detailed description, taken in conjunction with the accompanying drawings of which.

DETAILED DESCRIPTION OF THE INVENTION

Certain embodiments of the present invention will be explained below with reference to the accompanying drawings.

Figure 1:
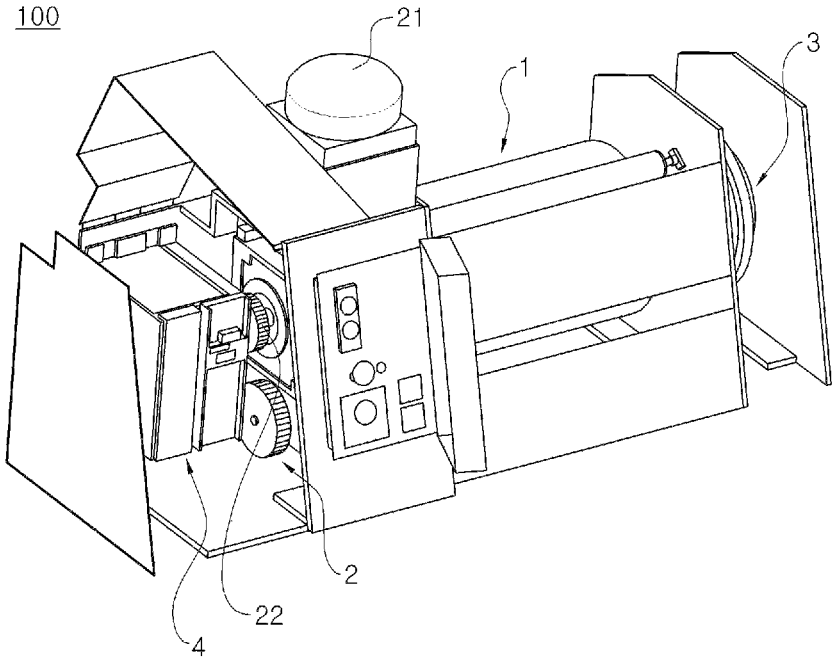
FIG. 1 is a schematic perspective view of a winch according to one embodiment of the present invention.
Figure 2:
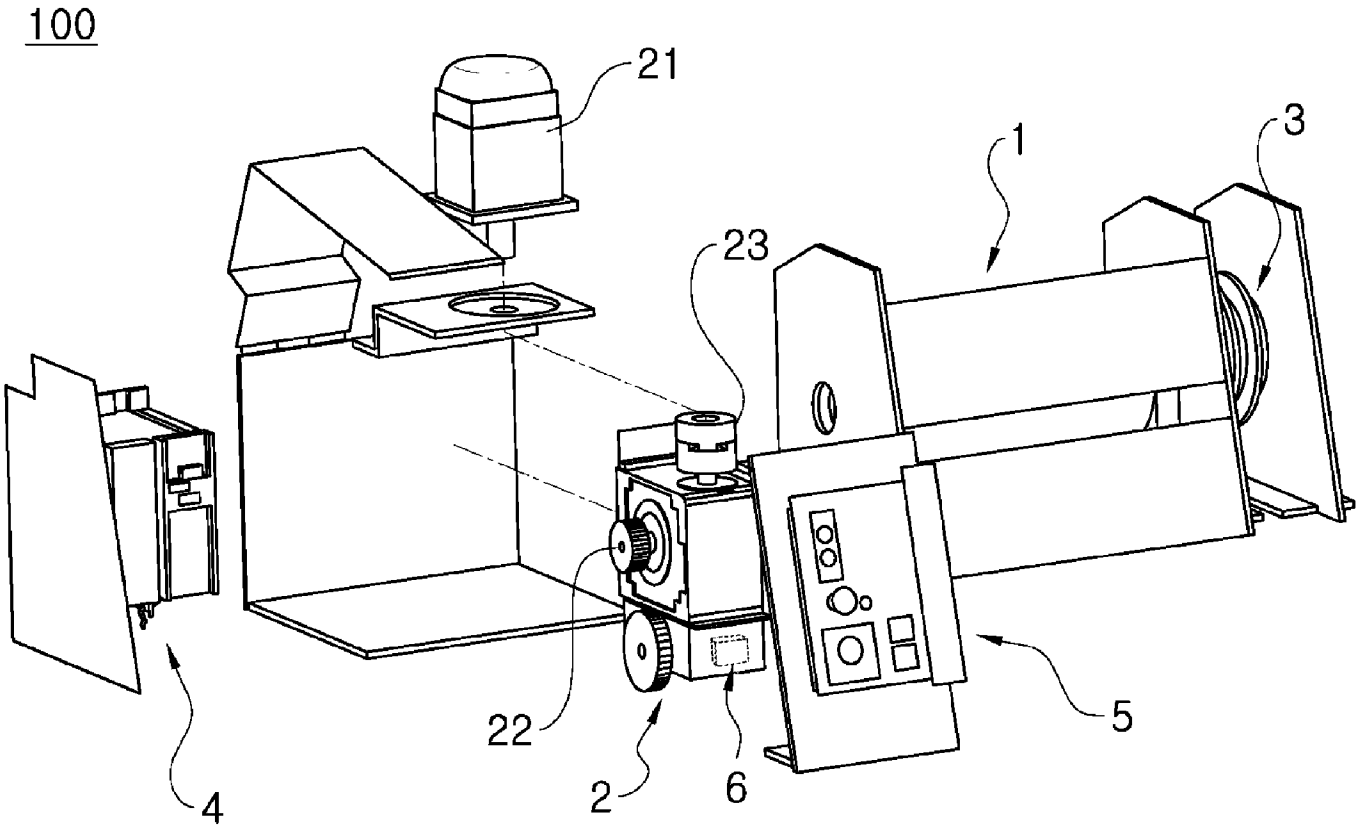
FIG. 2 is a schematic, exploded perspective view of the winch of FIG. 1.

FIG. 1 is a schematic perspective view of a winch according to one embodiment of the present invention, and FIG. 2 is a schematic, exploded perspective view of the winch of FIG. 1.

Referring to FIGS. 1 and 2, a winch 100 according to one embodiment of the present invention includes a drum unit 1, a motor unit 2, a brake module 3, a limit switch 6, and a servo-system 4. The winch 100 may additionally include a manually-driven control unit or a manual control unit 5 and an emergency switch.

First, the constitution of the drum unit 1 is explained below. The drum unit 1 is rotatably formed such that a wire 11 is wound or unwound thereon. By way of example, referring to FIG. 1, the drum unit 1 may include a drum in a cylindrical shape lying in a horizontal direction, along the circumference of which the wire 11 is either wound or unwound, and a rotating shaft connected to the motor unit 2 (to be explained below) to rotate the drum.

Next, the constitution of the motor unit 2 is explained.

The winch 100 is used in a manner in which the wire is wound around the drum unit 1 and unwound to a necessary length for use and then rewound, and the motor unit 2 supplies power to the drum unit 1 to wind or unwind the wire 11. The power supplied from the motor unit 2 may be implemented in the form of an output torque of a motor 21, although certain variations are possible. Further, the motor unit 2 may be connected to one end of the rotating shaft of the drum unit 1 to rotate the drum, thereby winding or unwinding the wire 11. The motor unit 2 may be arranged on one side of the drum unit 1 as illustrated in FIGS. 1 and 2.

Referring to FIGS. 1 and 2, the motor unit 2 may include a motor 21 which provides power, and a pulley 22 which transmits the power of the motor 21 to the drum unit 1. For reference, the motor 21 may include an electronic brake provided therein. In response to a command to stop received at a software level via the control unit 400, the motor 21 may be stopped by the electronic brake. Further, the electronic brake inside the motor 21 may operate in association with a limit switch 6 or emergency switch, when a command to stop is received at a hardware level via the limit switch 6 or emergency switch. The motor unit 2 may include a coupling 23 which engages the rotating shaft of the motor 21 provided as the power generator to the rotating shaft of a moving device including the pulley 22, thereby allowing the power from the motor 21 to be transmitted.

Next, the constitution of the brake module 3 will be explained.

The brake module 3 plays a role of stopping the rotation of the drum unit 1. Referring to FIGS. 1 and 2, the brake module 3 may be arranged on the other side of the drum unit 1. For example, the brake module 3 may be connected to the other end of the rotating shaft of the drum unit 1 to stop the rotation of the drum. Further, the brake module 3 may be an electronic brake type.

By way of example, if operation of the motor 21 is stopped via the limit switch 6 or emergency switch, which will be explained below, the brake module 3 is operated to rapidly stop the rotation of the drum unit 1. For reference, the electronic brake inside the motor 21 may also operate to ensure faster stopping of the rotation of the drum 1.

Next, the constitution of the limit switch 6 will be explained.

The limit switch 6 operates upon detecting a hardware limit state. By way of example, the hardware limit state may include a situation in which the length of the wire unwound from the drum unit 1 exceeds a preset permissible length range. Upon detecting the hardware limit state, the limit switch 6 mechanically blocks power to the motor unit 2 and operates the brake module 3 to thus stop the rotation of the drum unit 1. The brake module 3 may stop the rotation of the drum unit 1 via the electronic brake, and the electronic brake inside the motor 21 may also operate to ensure faster stopping of the rotation of the drum unit 1. For reference, the limit switch 6 may be provided in the motor unit 2, as exemplarily shown in FIG. 2 in dotted lines.

That is, the limit switch 6 may be implemented at a hardware level to mechanically block the power supply to the motor 21 to stop the operation thereof. By employing the limit switch 6 with the mechanical stopping mechanism in the winch 100, it is possible to ensure rapid stopping of the operation of the motor 21, particularly when it is necessary to stop the motor 21 faster than by stopping it through the route of using software level of stop command from the control unit 400. The example of operating the limit switch 6 will be explained in greater detail below with reference to the constitution of a local safety device 42.

For reference, the control unit 400 will be explained with reference to a winch safety system 1000 according to one embodiment of the present invention.

Next, the constitution of the servo-system 4 will be explained.

The servo-system 4 controls the motor unit 2 in accordance with a command from the control unit 400. Referring to FIGS. 1 and 2, the servo-system 4 may be arranged on one side of the motor unit 2. Further, the servo-system 4 may be connected to the motor unit 2 by wired or wireless manner to control the motor unit 2. For reference, the servo-system 4 may utilize a motor brake of the motor 21 to stop the driving of the motor unit 2 at a software level.

Figure 3:
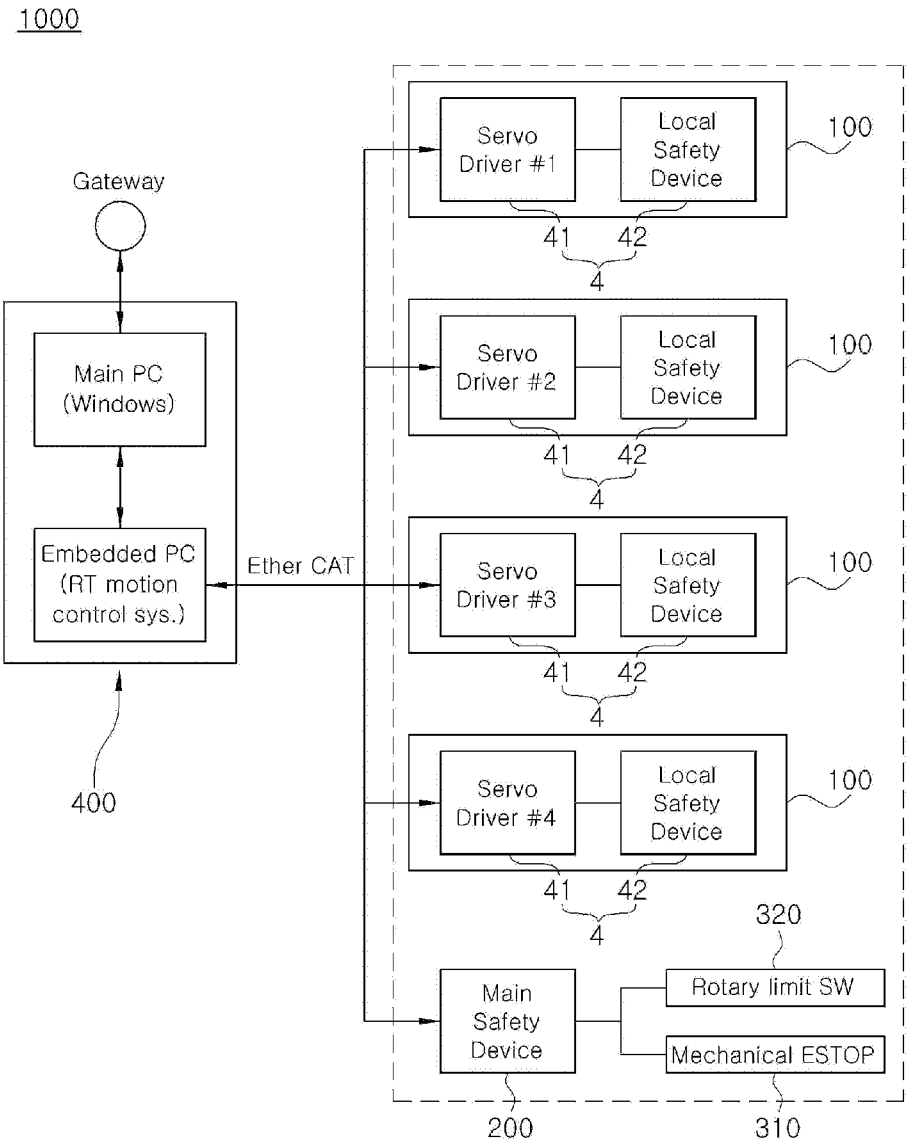
FIG. 3 is a schematic view of a winch safety system utilizing a winch according to one embodiment of the present invention.

FIG. 3 is a schematic view of a winch safety system utilizing a winch according to one embodiment of the present invention.

Referring to FIG. 3, the servo-system 4 provided in the winch 100 may include the local safety device 42 and may additionally include a servo-driver unit 41.

The servo-driver unit 41 may refer to a portion of the servo-system 4 that controls the motor unit 2 according to the command from the control unit 400. For example, the servo-driver unit 41 may include a subordinate communication unit which exchanges information with external devices such as the control unit 400 by EtherCAT.

Further, the local safety device 42 may determine the state of the winch 100, for example, the state of the wire 11 and the motor unit 2 according to local safety logic. The local safety device 42 may transmit the result of determining the state of the winch 100 according to the local safety logic to the control unit 400. As explained below, the information about the state of the winch 100 may include information about length of the wire 11 or output torque (power) of the motor unit 2, which may be transmitted to the control unit 400 as specific information or simple signal concept depending on needs.

As used herein, the 'local safety logic' may involve a procedure of logic to monitor the winch 100 and determine the state via the local safety device 42, but not limited thereto. That is, various methods may be implemented for the local safety logic to determine the safe state.

Figure 4:
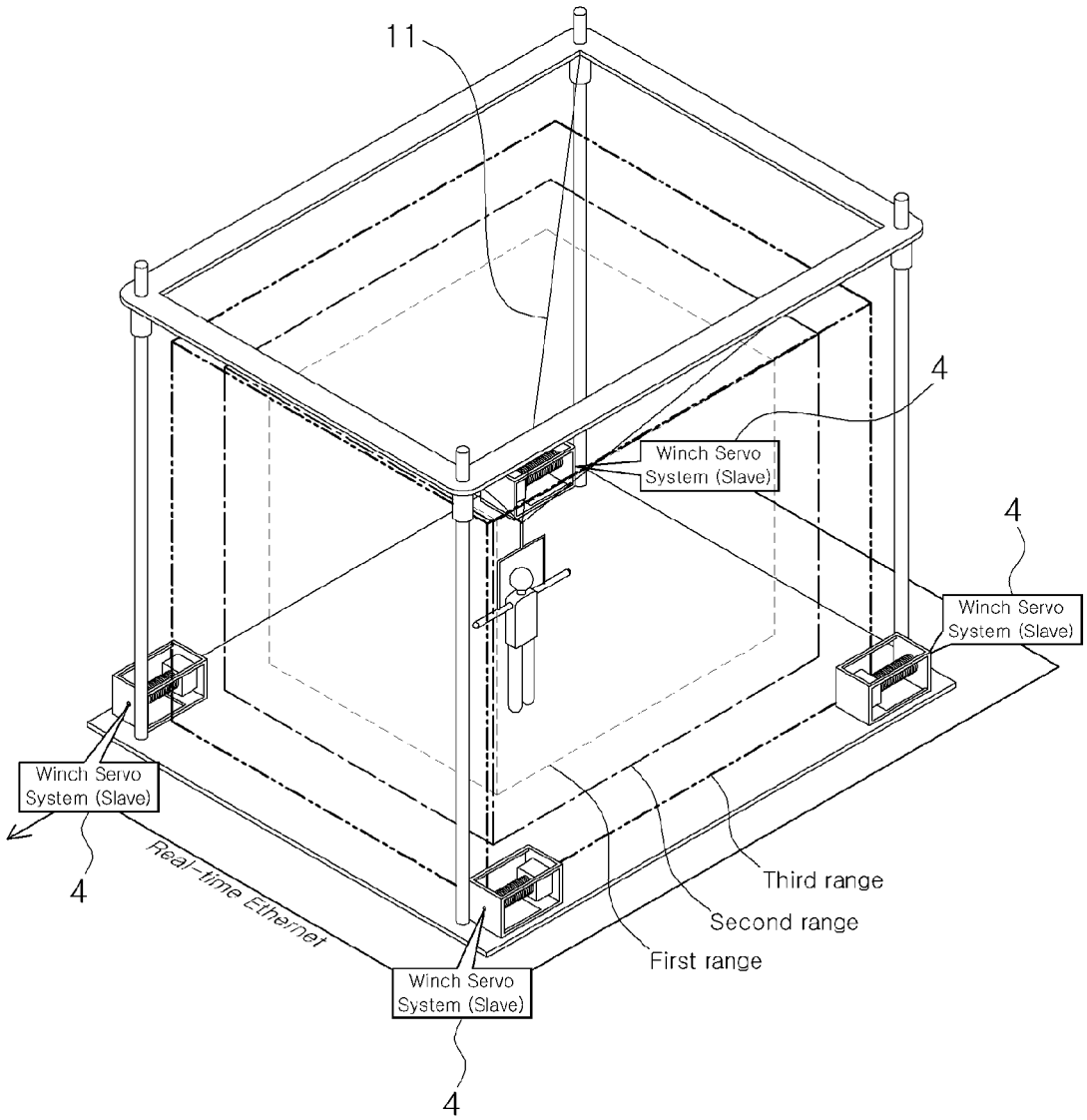
FIG. 4 is a conceptual view provided to explain a three dimensional wire flying system utilizing a winch according to one embodiment of the present invention.

FIG. 4 is a conceptual view provided to explain a three dimensional wire flying system utilizing a winch according to one embodiment of the present invention.

For example, referring to the first range illustrated in FIG. 4, if determining via the local safety logic that the current state is that the operating range of the wire 11 deviates from the first range only, the local safety device 42 transmits information about the deviation from the first range to the control unit 400 and the control unit 400 transmits a software limit signal to the servo-system 4 (e.g., servo-driver unit 41) to control the motor unit 2 so that the operating range of the wire 11 returns within the first range. That is, in the situation where the level of emergency is not too high to abruptly stop the winch 100, the control unit 400 may safely control the wire 11 via the command at software level.

Next, referring to the second range illustrated in FIG. 4, if determining via the local safety logic that the current wire state is the local warning state in which the length of the wire 11 unwound from the drum unit 1 exceeds a preset safe length (i.e., deviation from the second range), the local safety device 42 transmits information about the local warning state to the control unit 400, and the control unit 400 may transmit a software limit signal to the servo-system 4 (e.g., servo-driver unit 41) to stop the operation of the motor unit 2. For example, according to the control unit 400, the operation of the motor unit 2 may be stopped by the braking of the motor unit 2 itself.

The preset safe length (e.g., second range of FIG. 4) may be included in a preset permissible length (e.g., third range of FIG. 4) which will be explained in detail below. If the length of the currently-used wire 11 exceeds the preset permissible range (i.e., deviates from the third range), the limit switch 6 may mechanically perceive the hardware limit state as explained above and therefore, safe control at hardware level may be performed.

As explained above, the local safety logic may be so configured that the safe control at software level based on a preset range of safe length precedes the other controls, in which case the preset safe control at hardware level may be performed based on the preset permissible length when there is an abnormality in the safe control at software level.

Further, with respect to an aspect of the power provided to the drum unit 1, if the local safety logic determines the current state of the motor unit 2 to be the local warning state in which the power provided from the motor unit 2 to the drum unit 1 exceeds a preset power range, likewise in the local warning state where the length of the wire 11 unwound from the drum unit 1 exceeds the preset safe length, the local safety device 42 may transmit the information of the local warning state to the control unit 400 and the control unit 400 may stop the operation of the motor unit 2.

Based on a concept of output torque, the 'preset power range' as used herein may refer to the output torque of the motor 21 greater than 0 and less than a maximum permissible torque. If the output torque of the motor 21 is 0 or outside the maximum permissible torque during operation of the motor unit 2, such may indicate the presence of an abnormality in the motor 21.

Referring to the third range illustrated in FIG. 4, in a hardware limit state (i.e., deviation from third range) in which the length of the wire 11 unwound from the drum unit 1 for use exceeds a preset permissible length range, the limit switch 6, which mechanically detects the hardware limit state and operates accordingly, may mechanically block the power supply to the motor unit 2 and operate the brake module 3 to stop the rotation of the drum unit 1. At this time, the electronic brake provided in the motor 21 may also operate.

That is, if the length of the wire 11 in use exceeds the preset permissible length range, which is further aggravated situation than when the length deviates from the preset safe length, the safe control may be implemented so that instead of stopping the operation of the motor unit 2 via limit signal at software level, the limit switch 6 may operate based on the limit detection performed at hardware level.

The 'preset permissible length range (e.g., third range illustrated in FIG. 4) as used herein may be the widest range that is set, outside of which there is a potential problem of the safety. In other words, the 'preset permissible length range' may be a range of wire length that is so set as to mechanically operate the limit switch 6 independently from the other safety systems and thus ensure safety, when the safety system does not operate normally via software level command due to abnormality that may occur for software fault (S/W fault) in the multi safety system.

Further, the 'preset length range' as used herein may refer to a range of length of the wire 11 unwound from the drum unit 1 to be used, i.e., refer to the range that is preset to form a safe area for wire flying in the construction of a wire flying system.

Furthermore, in an emergency such as power failure, or glitch in safety logic, control unit 400, limit switch 6 or motor unit 2, the emergency switch may mechanically block the power supply to the motor unit 2 and stop the rotation of the drum unit 1 by operating the brake module 3. At this time, the electronic brake provided in the motor 21 may also operate. The emergency switch will be explained below with reference to the winch safety system 1000 according to one embodiment of the present invention.

Next, the constitution of the manual control unit 5 will be explained.

The manual control unit 5 may manually control the motor unit 2 and the brake module 3. By way of example, referring to FIGS. 1 and 2, the manual control unit 5 may be provided in front of the motor unit 2, and in the form of a switch panel. In additional to the automatic safety system including the local safety device 42 which provides several stages of safety as explained above, the manual control unit 5 is further provided. Accordingly, dual safety system consisting of automatic and manual safety systems can be provided. Therefore, the winch 100 can be used more safely.

Next, the operation of the winch 100 will be explained below with reference to the constitutions explained above. The winch 100 is operated in a manner in which, in normal operation, the motor unit 2 is controlled via the server-driver unit 41 which receives commands from the control unit 400, so that the wire 11 is wound or unwound to or from the drum unit 1. By way of example, if the operating range of the wire 11 exceeds the first range only (FIG. 4), the operating range of the wire 11 may be controlled at software level via the control unit 42 so that the operating range is returned to within the first range.

Then if the operating range of the wire 11 deviates from the second range (i.e., preset safe length range) illustrated in FIG. 4, the safe control may be implemented in which the driving of the motor unit 2 of the winch 100 is stopped at a software level via a stop command received from the control unit 42. The motor unit 2 may be stopped by the motor braking of the motor unit 2 itself, or the electronic brake of the motor 21 may operate.

Furthermore, if the operating range of the wire 11 deviates from the third range (i.e., preset permissible length range), this may be an abnormal situation where there is a problem in the safe control at software level via the control unit 42. That is, in a hardware limit state, which is very urgent, the limit switch 6, which operates independently from the local safety device 42 based on mechanical detection, may rapidly stop the driving of the winch 100.

The winch safety system 1000 utilizing the winch 100 explained above according to one embodiment of the present invention will be explained below, in which the elements identical or similar to those explained above with reference to the winch 100 will not be explained or briefly explained for the sake of brevity.

Referring to FIG. 3, the winch safety system 1000 according to one embodiment includes one or more winches 100, and an integrated safety device 200. Further, the winch safety system 1000 may additionally include an emergency switch (not illustrated), and a control unit 400.

First, the constitution of the winch 100 will be referenced to the description provided above.

Next, the constitution of the integrated safety device 200 will be explained.

The integrated safety device 200 may determine the state of one or more winches 100 according to safety logic. Further, the integrated safety device 200 may transmit to the control unit 400 the information regarding the state of one of more winches 100 as determined according to the safety logic.

By way of example, referring to FIG. 3, the winch safety system 1000 according to one embodiment of the present invention may include four winches 100 each including a servo system 4 consisting of a servo-driver unit 41 and a local safety device 42, and the integrated safety device 200 may be connected to the servo-systems 4 (e.g., servo-driver units 41) to determine the states of the four winches 100 according to the safety logic.

The 'safety logic' as used herein may refer to a processing of logic to monitor one or more winches 100 via, for example, integrated safety device 200, and determine the states thereof. That is, various methods for determining safety state may be implemented as the safety logic.

For example, referring to the first range illustrated in FIG. 4, if the safety logic determines that the operating range of the wire 11 corresponding to any of the one or more winches 100 deviates from the first range (FIG. 4) only, the integrated safety device 200 may transmit the information about the deviation from the first range to the control unit 400, and the control unit 400 transmits a software level control command to the servo-systems 4 (e.g., servo-driver units 41) of one or more winches 100 appropriately to control the corresponding motor units 2, so that the operating range of the corresponding wires 11 returns back into the first range. That is, because the situation is not too urgent to stop the operation of one or more winches 100, the command at software level from the control unit 400 may be used to safely control the wire 11.

Next, referring to the second range illustrated in FIG. 4, if determining via the local safety logic that any of one or more winches 100 is in the warning state in which the length of the wire 11 unwound from the drum unit 1 exceeds a preset safe length (i.e., deviation from the second range), the integrated safety device 200 may transmit information about the warning state to the control unit 400, and the control unit 400 may transmit a software limit signal to the servo-system 4 (e.g., servo-driver unit 41) of one or more winches 100 to stop the operation of one or more winches 100. For example, according to the control unit 400, the operation of the motor unit 2 of one or more winches 100 may be stopped by the braking of the motor unit 2 itself.

Further, with respect to an aspect of the power provided from the motor unit 2 to the drum unit 1, if the safety logic determines that any of one or more winches 100 is in warning state in which the power provided from the motor unit 2 to the drum unit 1 exceeds a preset power range, the integrated safety device 200 may transmit the information of the warning state to the control unit 400 and the control unit 400 may stop the operation of one or more winches 100.

Meanwhile, the integrated safety device 200 may coexist with the local safety devices 42 provided to each of one or more winches 100 in the winch safety system 1000 to be operated in synchronization with each other.

If any of one or more winches 100 determines that it is in local warning state via the local safety logic of the corresponding local safety device 42, the corresponding local safety device 42 transmits information about the local warning state to the integrated safety device 200, and the integrated safety device 200 may form an integrated synchronous motion to stop the operation of one or more winches 100 altogether.

That is, if the local safety device 42 monitors a problem occurring in one of one or more winches 100 so that the corresponding winch 100 is stopped, the integrated safety device 200 may operate together to thus cause the winch safety system 1000 to stop. In other words, if the local safety device 42 provided for one of the winches 100 monitors a problem in the corresponding winch 100 so that the corresponding winch 100 is stopped, the integrated safety device 200 may be synchronized with the respective local safety devices 42 of the winches 100 to control to stop all the other winches 100 too.

Further, if the safety logic of the integrated safety device 200 determines that any of one of more winches 100 is in warning state, the information regarding the warning state may be transmitted to the local safety devices 42 of the winches 100, respectively, to construct a local synchronous motion to cause the local safety devices 42 of the winches 100 to stop the operation of one or more winches 100, respectively. That is, the local safety devices 42 provided for the respective winches 100 may also operate when the operation is stopped via the integrated safety device 200, so that the entire winch safety system 1000 may be stopped.

For reference, if one of the winches 100 determines via the local safety logic of the corresponding local safety device 42 that it is in local warning state, the corresponding local safety device 42 may transmit information regarding the local warning state to the rest winches 100 so that the rest winches 100 perform jobs to stop operation thereof.

As explained above, more stable safety control is implemented, because the local safety device 42 self-monitors the safety state of the winch 100 that the local safety device 42 belongs to, while the integrated safety device 200 generally monitors the safety state of one or more winches 100, in a manner in which the two safety devices 42, 200 are operated in synchronization with each other.

Further, referring to the third range illustrated in FIG. 4, if any of one or more winches 100 is in hardware limit state (i.e., deviation from third range) in which the length of the wire 11 unwound from the drum unit 1 exceeds a preset permissible length, as explained above, the limit switch 6, which mechanically detects the hardware limit state and operates accordingly, may mechanically block power supply to the motor unit 2 and operate the brake module 3 to stop the rotation of the drum unit 1. At this time, the electronic brake provided in the motor 21 may also operate. That is, because limit switches are provided in the winches, respectively, the limit switches may mechanically detect the hardware limit state of each of the winches 100 to rapidly stop the motor unit 2 as explained above.

Furthermore, the servo-driver units 41 of one or more winches 100 and the integrated safety device 200 may include subordinate communication units for EtherCAT communication with each other or with the control unit 400. By way of example, the subordinate communication units may transmit information about the state of the wire 11, the drum unit 1, or the motor unit 2 to the control unit 400 and receive information about a command from the control unit 400.

The constitution of the emergency switch will now be explained below.

Independently from the local safe devices 42 or the integrated safety device 200, the emergency switch may mechanically detect abnormal state and control the motor unit 2 and the brake module 3. To be specific, the emergency switch may mechanically detect abnormal state, block power supply to the motor unit 2 and operate the brake module 3 to stop the rotation of the drum unit 1. Further, the emergency switch may operate the electronic brake within the motor 21.

By way of example, if the emergency state is caused due to power failure, the emergency switch may be a power-failure emergency switch which determines power failure. The power-failure emergency switch may determine power failure, and block power supply to the motor 21, while at the same time, operating the brake module 3. Further, the emergency state may be caused due to a problem in the safety logic, the control unit 400, the limit switch 6 or the motor unit 2.

Next, the constitution of the control unit 400 will be explained.

The control unit 400 may control one or more winches 100 by transmitting a command to control the motor unit 2 to the servo-system 4 of each of the winches 100. Further, the control unit 400 may receive information about safety state of one or more winches 100 from the local safety device 42 or the integrated safety device 200 and stop the operation of one or more winches 100 at software level.

Referring to FIG. 3, the control unit 400 may include a main PC and an embedded PC. By way of example, the main system may be a workstation PC which may be implemented as a TwinCAT and EtherCAT Master Stack. Further, the embedded system may be so configured that a command is transmitted to the servo-driver unit 41 of each of the winches 100 for RT motion control of the winch 100, and receive information about each constituent from each servo-driver unit 41. By way of example, the embedded system may implement TwinCAT and EtherCAT Master. By the use of the control unit 400 and the subordinate communication units, the winch safety system 1000 according to the present invention may operate as a network-based dispersion control system with fast synchronization control that is performed within 1 msec.

Referring to FIG. 3, the winch safety system 1000 according to one embodiment of the present invention may additionally include a mechanical emergency stop (ESTOP) button 310 and a rotary limit switch (SW) 320. Accordingly, multilevel of safety control that employs both automatic and manual controls is possible, because it is additionally possible to mechanically block power supply to the motor unit 2 with the ESTOP button and stop the rotation of the drum unit 1 with the rotary limit SW.

The stepwise operation of the winch safety system 1000 having the constitutions explained above will be explained below.

Figure 5:
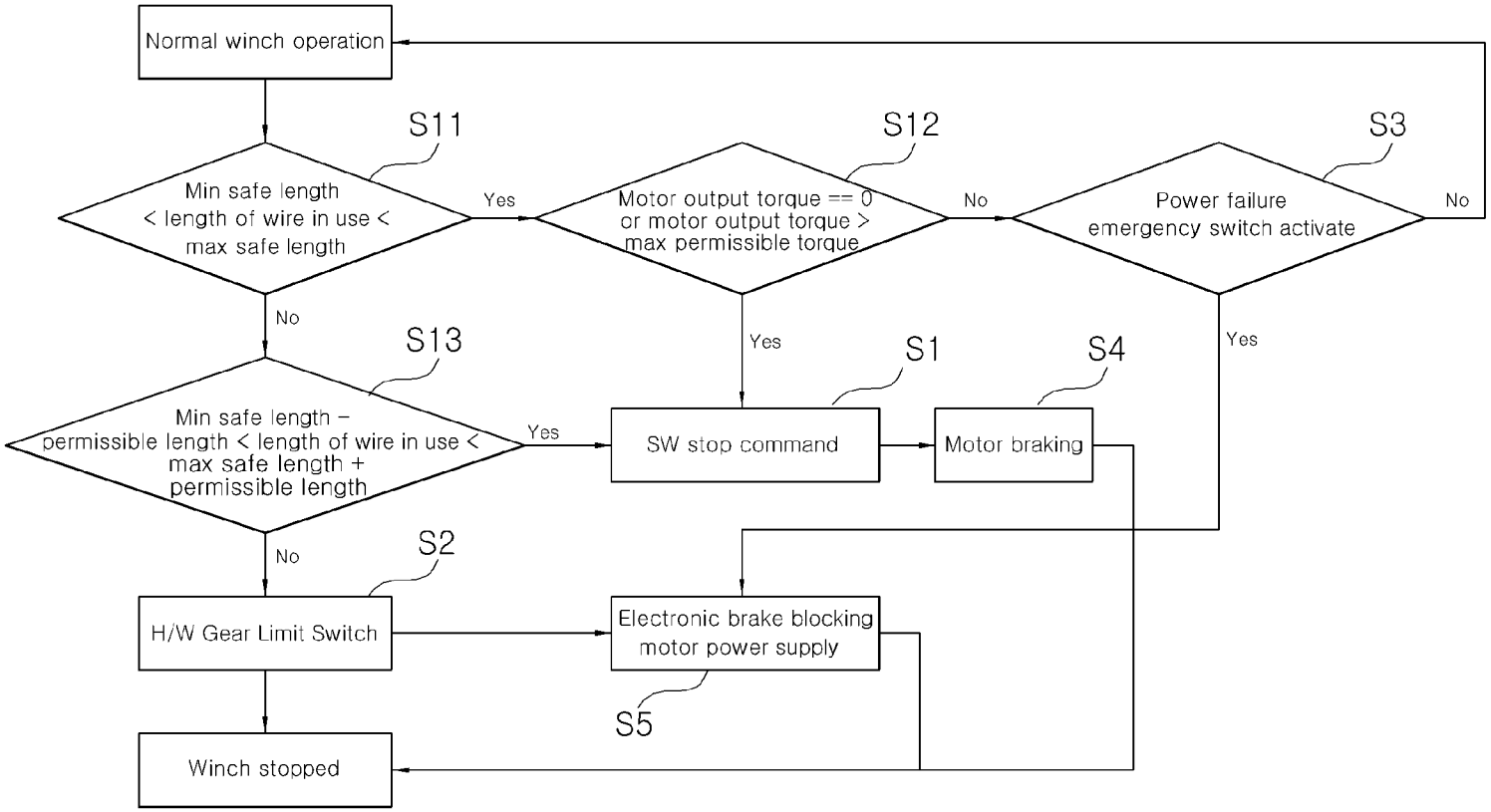
FIG. 5 is a flowchart provided to explain stepwise operation of a three dimensional wire flying system according to one embodiment of the present invention.

FIG. 5 is a flowchart provided to explain stepwise operation of a three dimensional wire flying system according to one embodiment of the present invention.

Referring to FIG. 5, at S11 to S12, if the local safety device 42 or the integrated safety device 200 determines that the length of the wire 11 in use does not exceed a predetermined safe length range, and determines at S12 to S3, that the output torque of the motor 21 is other than 0 and within a maximum permissible torque, and also if the emergency switch does not operate, the winch 100 is continuously operated in a normal condition. However, if power failure occurs, the power-failure emergency switch is operated at S3 to S5, so that the power supply to the motor of the corresponding winch 100 is blocked, and the rotation of the drum unit 1 is rapidly stopped via the brake module 3.

At S11 to S12, even when the length of the wire 11 in use is yet within the preset safe length range, if the output torque of the motor 21 is 0 or greater than the maximum permissible torque at S12 to S1, the situation may be determined to be in (local) warning state at software level via the (local) safety logic, in which case the local safety device 42 or the integrated safety device 200 may transmit the information about the (local) warning state or synchronize with each other, and the control unit 400 receives the (local) warning state information to stop (at S1) the operation of the motor unit 2 at software level.

Further, at S11 to S13, if the length of the wire 11 in use does exceed the preset safe length range, and if the length is yet within the preset permissible range at S13 to S1, such situation may be determined via the (local) safety logic to be the (local) warning state at software level, in which case the local safety device 42 or the integrated safety device 200 may transmit the information about the (local) warning state or synchronize with each other, and the control unit 400 receives the (local) warning state information to stop (at S1) the operation of the motor unit 2 at software level.

Further, at S13 to S2, if the length of the wire 11 in use exceed the preset permissible length range, the situation is determined to be in hardware limit state, in which case the limit switch 6 for mechanically detecting such situation and operating accordingly, may mechanically block the power supply to the motor unit 2 and may stop the rotation of the drum unit 1 via the brake module 3 faster than the safety control at software level.

According to the present invention, multilevel safety system can be established stably based on virtual operating space setup and implementation thereof over three stages as explained above. Further, because one or more winches 100 each has the manual control unit 5, user is able to do safety control using the manual control unit 5.

Meanwhile, a method of winch safety control (referred to as 'winch safety control method' hereinafter) according to one embodiment will be explained below with reference to FIG. 5, in which the explanation about the like elements explained above with reference to the winch 100 or the winch safety system 1000 will be omitted or given briefly for the sake of brevity.

For reference, a winch used in the winch safety control method will be given the same reference numeral 100 as the one explained above, and may include components as explained below.

Referring to FIG. 5, the winch safety control method includes determining a safe length via safety logic in which it is determined if the length of the wire 11 unwound from the winch 100 for use is within a preset safe length range (at S11), determining motor power via the safety logic in which it is determined if the output torque of the motor 21 provided in the winch 100 is 0, or greater than a maximum permissible torque (at S12), transmitting a command to stop at software level from a control unit 400, if it is determined via the safety logic that the length of the wire 11 exceeds the preset safe length range (at S1), determining a permissible length in which a limit switch 6 mechanically determines if the length of the wire 11 exceeds the preset permissible length range (at S13), receiving the command to stop at software level from the control unit 400, if it is determined via the safety logic that the output torque of the motor 21 is 0 or greater than the maximum permissible torque (at S1), stopping the driving of the winch 100 according to operation state of the motor 21 which is stopped in response to the command to stop at software level (at S4), and stopping the driving of the winch 100 by the limit switch 6 which mechanically blocks power supply to the motor 21 and operates the brake module 3 (at S5).

The safety logic may be a local safety logic mentioned when explaining the winch 100, or the safety logic mentioned when explaining the winch safety system 1000.

The determining of the safe length (at S11) may precede the determining of the motor power (at S12). These two operations may be performed in certain order, because when performed concurrently, difficulty may arise in determining a direction of implementing the operations.

Further, the winch safety control method may additionally include stopping the driving of the winch 100 by an emergency switch for mechanically detecting emergency state and operating accordingly, which blocks power supply to the motor 21 and operates the brake module 3 (at S3), in which the emergency may arise due to a power failure, a problem in the safety logic which results in a problem in the determination of length of the wire 11 or a size of output torque of the motor 21, or a problem in the control unit 400, the limit switch 6 or the motor 21 which results in abnormality in the controlling of the length of the wire 11. The emergency switch may be a power-failure switch which determines power failure.

The three dimensional wire flying system according to the present invention may be used in performances or plays at theatres.

While the present invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A three dimensional wire flying system comprising:

a plurality of winches collectively hanging an object; and a control unit for controlling the plurality of winches and the main safety device, wherein each of the plurality of winches includes:

a drum unit, a wire wound on the drum unit, wherein a length of the wire unwound from the drum unit is adjustable by unwinding the wire from the drum unit or winding the wire on the drum unit;

a motor unit which provides power to the drum unit, a brake module which stops rotation of the drum unit, a limit switch which operates upon detecting a hardware limit state, and a servo-system including a servo-driver unit which controls the motor unit in response to a command from a control unit, the servo-system further including a local safety device which determines state of the wire and the motor unit according to a local safety logic and transmits the state of the wire and the motor unit to the control unit, wherein each of the plurality of winches operates to move the object in a three dimensional space in three directions perpendicular to each other, including an up-down direction, a left-right direction and a forward-backward direction;

the three dimensional space includes a first range, a second range corresponding to a preset safe length of the wire, and a third range corresponding to a preset permissible length range of the wire, the second range being greater than the first range and including the first range, the third range being greater than the second range and including the second range, each of the plurality of winches provides a multi-level safety protection to the three dimensional wire flying system such that;

if the local safety logic determines that operating range of the wire deviates from the first range only, the local safety device transmits information about the deviation from the first range to the control unit, and the control unit transmits a first software signal to the servo-system to control the motor unit to move the object in said three directions in the three-dimensional space, so that the operating range of the wire returns into the first range, if the local safety logic determines that the length of the wire deviates from the second range but within the third range, the local safety device transmits information about the deviation from the second range to the control unit, and the control unit transmits a second software signal to the servo-system to stop the operation of the motor unit, and if the local safety logic determines that the length of the wire deviates from the third range, the limit switch detects the hardware limit state and mechanically stops the operation of the motor unit to thus stop the rotation of the drum unit, thereby implementing safety control at hardware level.

2. The three dimensional wire flying system of claim 1, wherein, if the local safety logic determines a local warning state in which the power provided by the motor unit to the drum unit is 0 or deviates from a preset power range, the local safety device transmits information about the local warning state to the control unit, and the control unit stops the operation of the motor unit.

3. The three dimensional wire flying system of claim 1, wherein the servo-driver unit of each of the plurality of winches includes a subordinate communication unit for EtherCAT communication with the control unit.

4. The three dimensional wire flying system of claim 1, wherein the integrated safety device and the servo-driver unit of each of the plurality of winches, respectively, include a subordinate communication unit for EtherCAT communication with each other and with the control unit.

5. The three dimensional wire flying system of claim 1, further comprising a manual control switch panel provided in front of the motor unit, for manually controlling the motor unit and the brake module.

6. The three dimensional wire flying system of claim 1, further comprising an integrated safety device which determines state of the plurality of winches according to the local safety logic and transmits information about the state of the plurality of winches to the control unit.

7. The three dimensional wire flying system of claim 6, wherein, if the local safety logic determines a local warning state in which any of the plurality of winches has deviation of the length of the wire unwound from the drum unit from the second range or in which the power provided by the motor unit to the drum unit deviates from a preset power range, the integrated safety device transmits information about the local warning state to the control unit and the control unit stops the operation of the plurality of winches altogether.

8. The three dimensional wire flying system of claim 7, wherein, if any of the plurality of winches is determined to be in the local warning state via the local safety device of said any of the plurality of winches, the local safety device of said any of the plurality of winches transmits information about the local warning state to the integrated safety device to implement an integrated synchronous motion in which the integrated safety device stops the operation of all of the plurality of winches.

9. The three dimensional wire flying system of claim 8, wherein the integrated safety device transmits information about the local warning state to the local safety devices of the plurality of winches to implement a local synchronous motion in which the local safety devices of the plurality of winches stop the operation of the plurality of winches, respectively.

10. The three dimensional wire flying system of claim 8, further comprising an emergency switch which, independently from the local safety device or the integrated safety device, mechanically detects emergency state to control the motor unit and the brake module.

* * * * *